US005628391A

United States Patent [19]

Völkening et al.

[11] Patent Number: 5,628,391

[45] Date of Patent: May 13, 1997

[54] FLOORPLATE FRAME FOR A PEOPLE MOVING DEVICE

[75] Inventors: Heinz Völkening, Hespe; Thomas Lis, Hanover, both of Germany

[73] Assignee: Otis Elevator Company, Farmington, Conn.

[21] Appl. No.: 173,744

[22] Filed: Dec. 23, 1993

[51] Int. Cl.[6] ..... B66B 29/08

[52] U.S. Cl. ..... 198/325

[58] Field of Search ..... 198/321, 324, 198/325

[56] References Cited

U.S. PATENT DOCUMENTS

| | | | |
|---|---|---|---|
| 1,956,154 | 4/1934 | Lindquist et al. | 198/325 |
| 2,862,599 | 12/1958 | Sinden et al. | 198/324 X |
| 3,107,377 | 10/1963 | Nathan . | |
| 3,926,296 | 12/1975 | Woodling et al. | 198/325 |
| 5,029,690 | 7/1991 | Nguyen et al. | 198/335 |
| 5,372,231 | 12/1994 | Volkening et al. | 198/325 |

FOREIGN PATENT DOCUMENTS

| | | | |
|---|---|---|---|
| 2458759 | 6/1975 | Germany . | |
| 405078077 | 3/1993 | Japan | 198/324 |
| 571454 | 1/1976 | Switzerland . | |

*Primary Examiner*—D. Glenn Dayoan

[57] ABSTRACT

A floorplate frame for supporting the floorplate of a people moving device is provided, including a sill, having an extruded cross-sectional profile, and a plurality of fasteners. The cross-sectional profile includes a back and a body. A pad is provided including an elastomeric formed into a shape comprising a top surface and bottom surface. The bottom surface includes a tab extending outwardly. The bottom surface of the pad further includes a plurality of ribs extending outwardly to attenuate vibration propagating between the floorplate frame and the floorplate.

6 Claims, 2 Drawing Sheets

FLOORPLATE FRAME FOR A PEOPLE MOVING DEVICE

BACKGROUND OF THE INVENTION

1. Technical Field

This invention relates to people moving devices in general, and to floorplate support systems for people moving devices in particular.

2. Background Art

Escalators, moving walkways, and other people moving devices efficiently move a large volume of pedestrian traffic from one point to another. At each end of the device, landing areas provide access to moving steps (or belts, or pallets) traveling at a constant rate of speed. The landing areas typically include floorplates and a combplate. The floorplates cover a structural frame which, in the landing, houses mechanical equipment for actuating the moving steps. The combplate is an intermediary surface between the stationary floor plates and the moving steps.

The structural frame comprises a left and a right truss connected by structural members extending therebetween. By convention, the side of the escalator on the left of a person facing the escalator at the lower elevation is called the left hand side of the escalator, and the side to the person's right is called the right hand side. Each truss section has two end sections parallel to one another, connected by an inclined midsection. The end sections form the landings at each end of the midsection.

It is known in the art that the floorplates may be positioned and supported off of the frame by a plurality of brackets and commercially available structural steel having an "L" shaped cross-section, also known as "angle iron". Sections of angle iron are cut and assembled into a floorplate frame which is then attached to the brackets. After the floorplate frame is attached to the brackets, the floorplates are placed within the frame and conventionally attached.

A person of skill in the art will recognize that the "quietness" of a people moving device is perceived as an indicia of the quality of the machine. A problem with the aforementioned floorplate frame arrangement is that it permits vibrations, and therefore noise, to propagate from the device frame to the floorplates via the floorplate frame.

A further disadvantage of floorplate frame fabricated from structural steel is that the angle iron must typically be altered to permit the frame to be attached to the brackets that support the floorplate frame.

DISCLOSURE OF THE INVENTION

It is, therefore, an object of the present invention to provide a floorplate frame for a people moving device which minimizes noise.

It is a further object of the present invention to provide a floorplate frame for a people moving device which facilitates assembly of the people moving device.

According to the present invention, a floorplate frame for supporting the floorplate of a people moving device is provided, comprising a sill, having an extruded cross-sectional profile, and a plurality of fasteners. The cross-sectional profile comprises a back and a body.

According to one aspect of the present invention, a pad is provided comprising and elastomeric formed into a shape comprising a top surface and a bottom surface. The bottom surface includes a tab extending outwardly.

According to another aspect of the present invention, the bottom surface of the pad further comprises a plurality of ribs extending outwardly to attenuate vibration between the floorplate frame and the floorplate.

An advantage of the present invention is that the floorplate frame and pad assembly significantly reduces noise caused by vibration. A person of skill in the art will recognize that decreasing the noise associated with a people moving device enhances the device's perception of quality.

A further advantage of the present invention is that the extruded cross-sectional profile of the sill facilitates the assembly of the people moving device. The extruded sill eliminates the need for alterations for attachment purposes.

These and other objects, features and advantages of the present invention will become more apparent in light of the detailed description of the best mode embodiment, thereof, as illustrated in the accompanying drawings.

DETAILED DESCRIPTION OF THE DRAWINGS

BEST MODE FOR CARRYING OUT THE INVENTION

Figure 1:
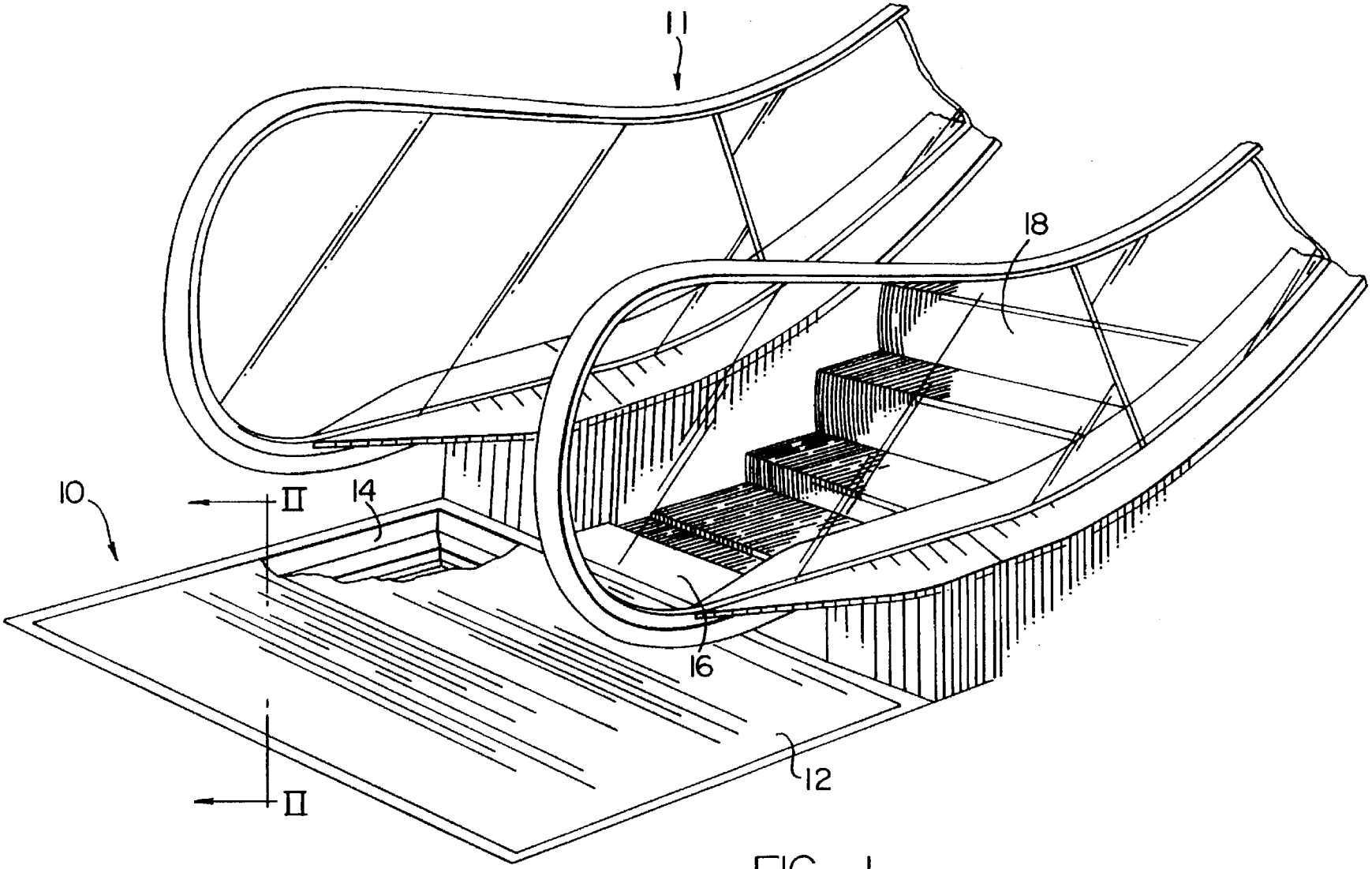
FIG. 1 is a diagrammatic view of the landing a people moving device.

Now referring to FIG. 1, a landing 10 for an escalator 11 includes a floorplate 12, a floorplate frame 14, a combplate 16, and moving treadplates 18. The combplate 16 is an intermediary surface between the moving treadplates 18 and the stationary floorplate 12. The floorplate 12, which may comprise one or more sections, covers the mechanical apparatus (not shown) in the landing 10. The floorplate frame 14 attaches to the structural frame 20 (see FIG. 2) of the escalator 11 and supports the floorplate 12 in the landing 10.

Figure 2:
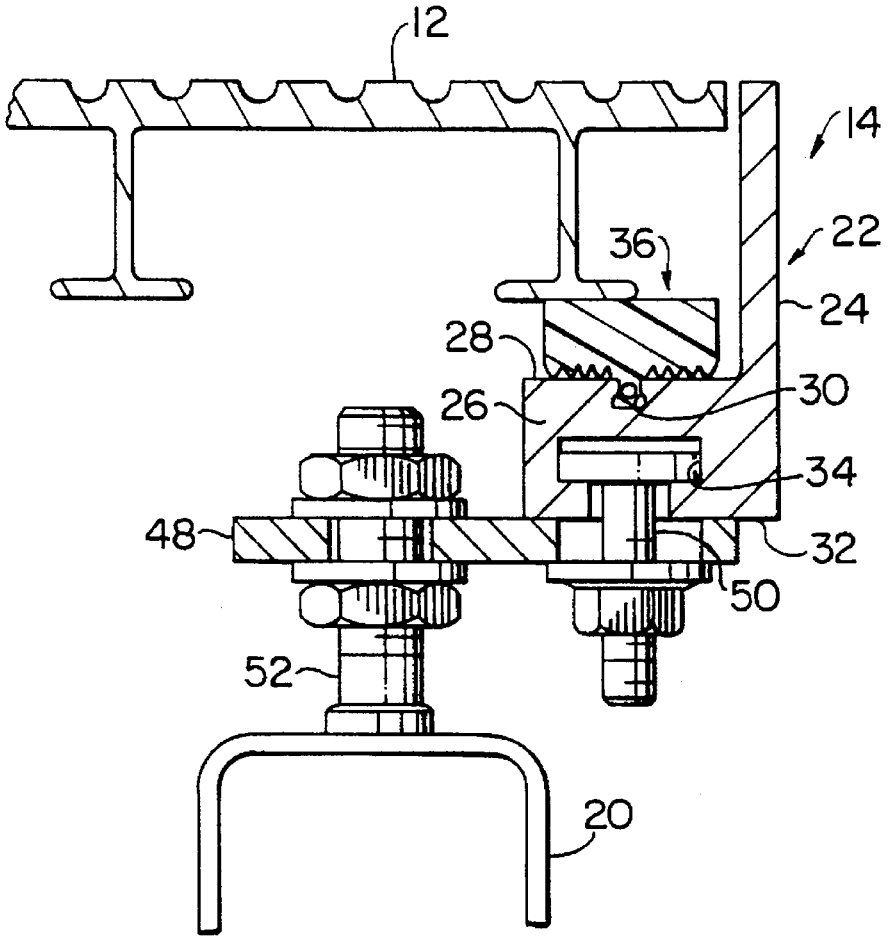
FIG. 2 is a partial cross-section view of the floorplate and floorplate frame shown in FIG. 1.

Referring to FIG. 2, the floorplate frame 14 comprises a sill 22 having an extruded cross-sectional profile. The sill 22 includes a back 24 and a body 26 extending along the length of the sill 22. The body 26 has a top surface 28 having a first slot 30 and a bottom surface 32 having a second slot 34. In the preferred embodiments, the first slot 30 is "Y" shaped and the second slot 34 is "T" shaped.

Figure 3:
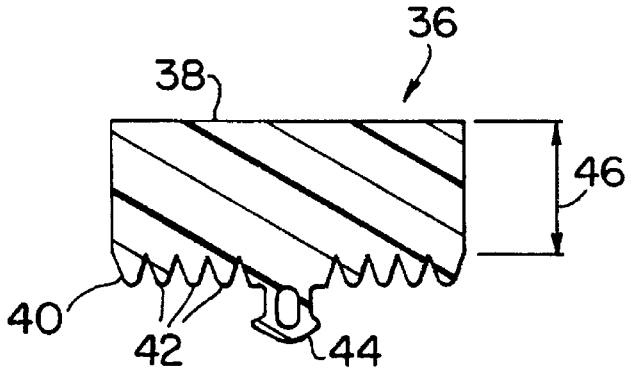
FIG. 3 is an enlarged cross-section view of the pad shown in FIGS. 1 and 2.

The floorplate frame 14 further comprises a pad 36 comprising an elastomeric material. Referring to FIG. 3, the pad 36 is formed into a shape comprising a top surface 38 and a bottom surface 40. The bottom surface 40 includes a plurality of ribs 42 and a tab 44 extending outwardly. The geometry of the tab 44 is such that the tab 44 and the first slot 30 form mating male and female "Y" shaped pairs for securing the pad 36 to the top surface 28 (see FIG. 2) of the sill 22. A person of skill in the art will recognize that differently shaped mating male and female pairs may be used alternatively. A person of skill in the art will further recognize that the material of the pad 36 and the distance 46 between the top 38 and bottom 40 surfaces of the pad 36, or the "thickness" of the pad, may be altered to change the isolation characteristics of the pad 36.

The geometry of the ribs 42 is such that the surface area of the ribs 42 in contact with the top surface 28 of the sill 22 is less than the surface area of the pad 36 bottom surface 40. Within this limitation, however, a person of skill in the art will recognize that the ribs 42 may run longitudinally along the length of the pad 36, or widthwise across the pad 36, or in fact may be randomly shaped and still facilitate the attenuation of vibration between the floorplate frame 14 and the floorplate 12.

Referred to FIG. 2, brackets 48 attach the floorplate frame 14 to the frame 20 of the escalator 11 (see FIG. 1). Conventional "T" shaped fasteners 50, received within the second slot 34 of the sill 22, attach the floorplate frame 14 to one end of the bracket 48. A person of skill in the art will recognize that the "T" shaped head of each fastener 50 and the second slot 34 form a mating male and female for securing the floorplate frame 14 to the bracket 48. Differently shaped mating male and female pairs, or other type clips may alternatively be used. Studs 52, conventionally attached to the frame 20 of the escalator 11 (FIG. 1), attach the other end of the brackets 48 to the escalator frame 20.

In the assembly of the escalator 11 (FIG. 1), the brackets 48 are mounted on the frame 20 of the device and adjusted for height relative to one another. The floorplate frame 14 and pad 36 are preassembled, placed on top of the brackets 48, and secured using the "T" shaped fasteners 50. The combination of the "T" shaped fasteners 50 and the extruded sill 22 eliminate the need to alter the floorplate frame 14 during attachment.

Although this invention has been shown and described with respect to the detailed embodiments thereof, it will be understood by those skilled in the art that various changes in form and detail thereof may be made without departing from the spirit and scope of the claimed invention.

We claim:

1. A floorplate frame for supporting the floorplate of a people moving device, comprising:

a sill, having an extruded cross-section comprising, a back;

a body, having a top surface and a bottom surface, said top surface having a first slot, and said bottom surface having a second slot; and means for attaching said sill to a structural member of the people moving device;

wherein the floorplate lies on said top surface of said sill and is received between said back of said sill.

2. A floorplate frame for a people moving device according to claim 1, wherein said means for attaching comprises:

a plurality of fasteners, each fastener having a head, wherein said head and said second slot form mating male and female pairs for securing said sill.

3. A floorplate frame for a people moving device according to claim 1, further comprising an elastomeric pad, wherein said pad is received between said floorplate frame and the floorplate for attenuating vibration.

4. A floorplate frame for a people moving device according to claim 3, wherein said pad comprises:

a top surface; and a bottom surface, having a plurality of ribs and a tab extending out from said bottom surface;

wherein said tab and said first slot form mating male and female pairs for securing said pad to said sill; and wherein said plurality of ribs extending out from said pad minimize the contact area between said pad and said sill to maximize the attenuation of vibrations therebetween.

5. A floorplate frame for a people moving device according to claim 2, further comprising an elastomeric pad, wherein said pad is received between said floorplate frame and the floorplate for attenuating vibration.

6. A floorplate frame for a people moving device according to claim 5, wherein said pad comprises:

a top surface; and a bottom surface, having a plurality of ribs and a tab extending out from said bottom surface;

wherein said tab and said first slot form mating male and female pairs for securing said pad to said sill; and wherein said plurality of ribs extending out from said pad minimize the contact area between said pad and said sill to maximize the attenuation of vibrations therebetween.

* * * * *